US009658028B1

(12) United States Patent
McLean

(10) Patent No.: US 9,658,028 B1
(45) Date of Patent: May 23, 2017

(54) FEMALE FORM FITTING BUTTSTOCK

(71) Applicant: Earl McLean, Fuquay Varina, NC (US)

(72) Inventor: Earl McLean, Fuquay Varina, NC (US)

( * ) Notice: Subject to any disclaimer, the term of this patent is extended or adjusted under 35 U.S.C. 154(b) by 0 days.

(21) Appl. No.: 15/185,169

(22) Filed: Jun. 17, 2016

(51) Int. Cl.
*F41C 23/00* (2006.01)
*F41C 23/20* (2006.01)
*F41C 23/08* (2006.01)

(52) U.S. Cl.
CPC ..... *F41C 23/20* (2013.01); *F41C 23/08* (2013.01)

(58) Field of Classification Search
USPC ..... 42/71.01, 74, 73
See application file for complete search history.

(56) References Cited

U.S. PATENT DOCUMENTS

| | | | | |
|---|---|---|---|---|
| 4,769,937 | A | 9/1988 | Gregory et al. | |
| 5,149,899 | A | 9/1992 | Dabrowski | |
| 5,970,642 | A | 10/1999 | Martin | |
| 6,662,485 | B2 | 12/2003 | Kay | |
| 7,104,002 | B2 | 9/2006 | Rotundo | |
| 7,386,952 | B1 | 6/2008 | Henretty | |
| 8,832,984 | B1 * | 9/2014 | Vesligaj | F41C 23/06 42/74 |
| 8,844,185 | B2 | 9/2014 | Jarboe | |
| 8,955,245 | B2 | 2/2015 | Chvala | |
| 9,074,839 | B2 | 7/2015 | Warburton | |
| 2005/0241205 | A1 * | 11/2005 | Rotundo | F41C 23/14 42/71.01 |
| 2011/0302817 | A1 | 12/2011 | deBrun et al. | |
| 2014/0109453 | A1 * | 4/2014 | Paquette | F41C 23/14 42/73 |
| 2016/0123697 | A1 * | 5/2016 | Balgaard | F41C 23/08 42/74 |

* cited by examiner

*Primary Examiner* — J. Woodrow Eldred

(57) ABSTRACT

A female form fitting buttstock for increased comfort, accuracy and enjoyment when shooting includes a stock that has a top, a fore end and a butt end. The fore end is configured to couple to a receiver of a shotgun that has a rib sight. A pad is reversibly couplable to the butt end, which is positively pitched. The pad and the fore end are positioned such that a length of pull measurement of thirty to forty centimeters is obtained upon coupling of the stock to the receiver. The top of the stock comprises a comb that has a top edge, which is linear and parallel to the rib sight. The toe is positioned outside of a plane defined by the top edge of the comb and the rib sight. The stock is configured to comfortably position within a shoulder pocket of a female user.

20 Claims, 5 Drawing Sheets

FEMALE FORM FITTING BUTTSTOCK

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to buttstocks and more particularly pertains to a new buttstock for increased comfort, accuracy and enjoyment when shooting.

BRIEF SUMMARY OF THE INVENTION

An embodiment of the disclosure meets the needs presented above by generally comprising a stock that has a top, a fore end and a butt end. The fore end is configured to couple to a receiver of a shotgun that has a rib sight. A pad is reversibly couplable to the butt end, which is positively pitched. The pad and the fore end are positioned such that a length of pull measurement of thirty to forty centimeters is obtained upon coupling of the stock to the receiver. The top of the stock comprises a comb that has a top edge, which is linear and parallel to the rib sight. The toe is positioned outside of a plane defined by the top edge of the comb and the rib sight. The stock is configured to comfortably position within a shoulder pocket of a female user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
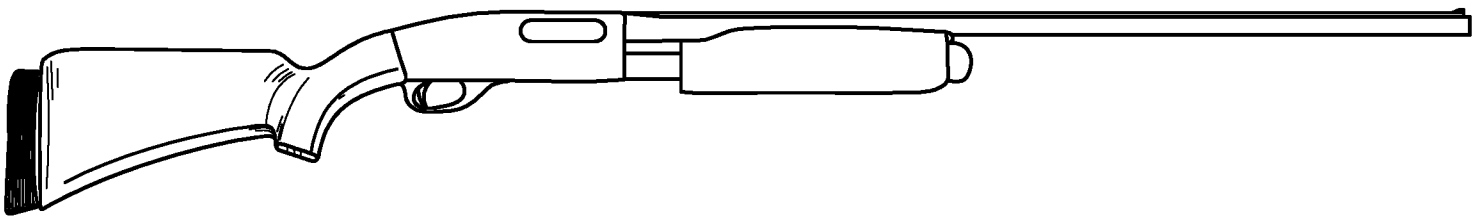
FIG. 1 is a side view of a female form fitting buttstock according to an embodiment of the disclosure.
Figure 2:
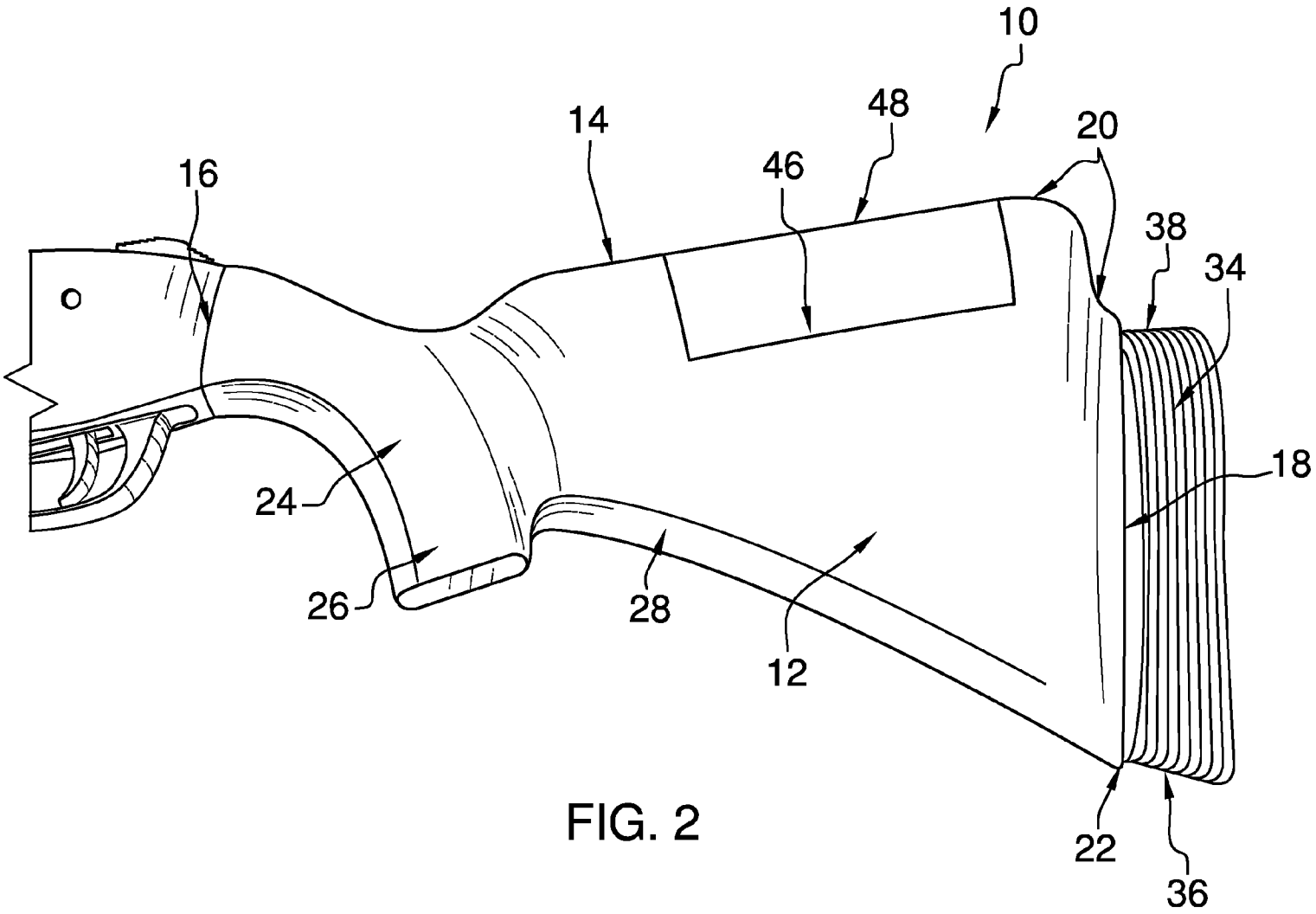
FIG. 2 is a side view of an embodiment of the disclosure.
Figure 3:
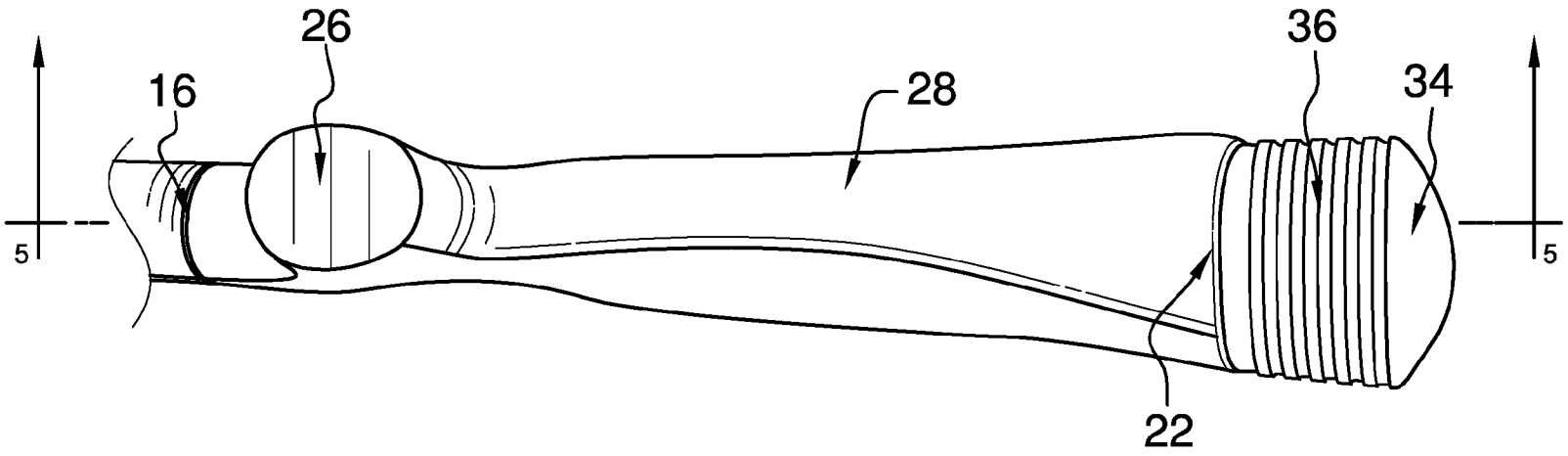
FIG. 3 is a bottom view of an embodiment of the disclosure.
Figure 4:
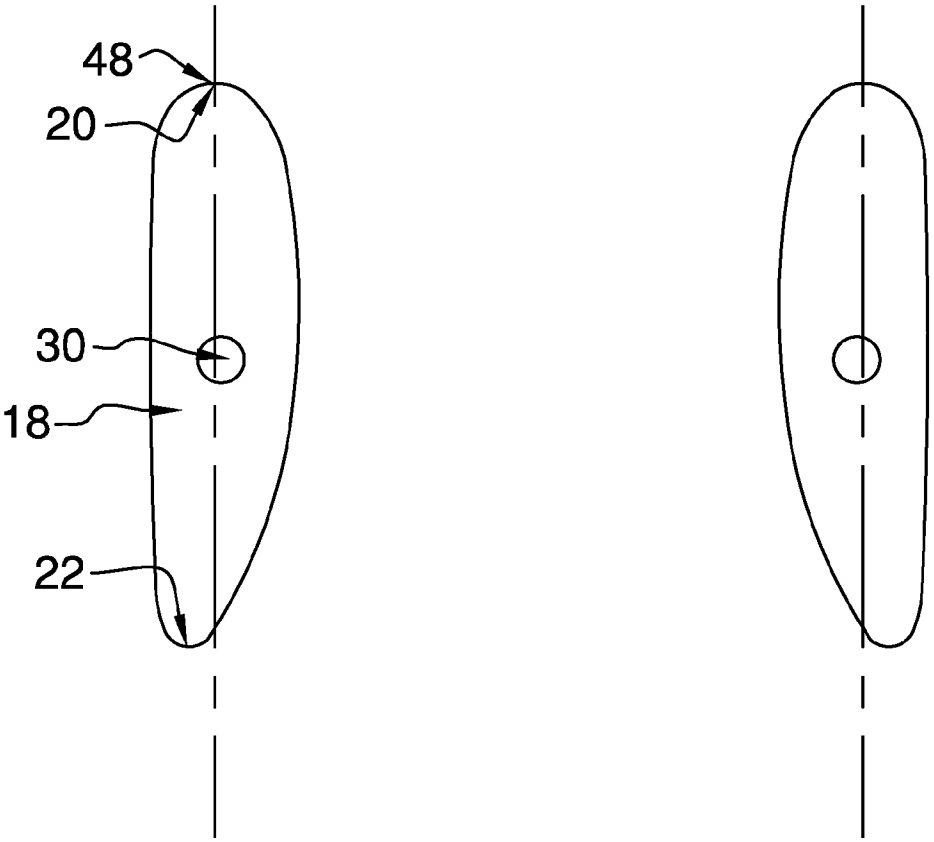
FIG. 4 is an end view of an embodiment of the disclosure.
Figure 5:
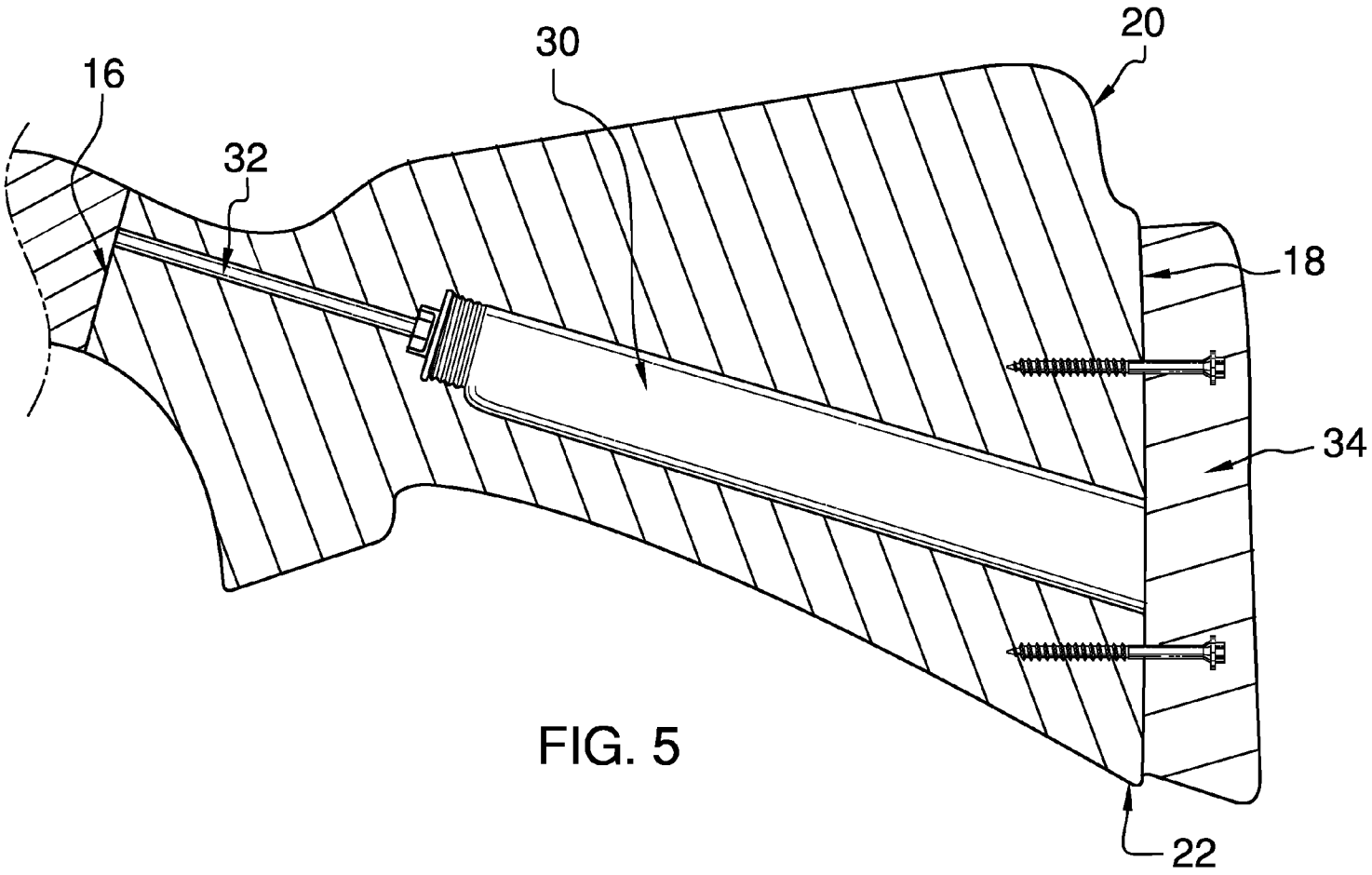
FIG. 5 is a cross-sectional view of an embodiment of the disclosure.

With reference now to the drawings, and in particular to FIGS. 1 through 5 thereof, a new buttstock embodying the principles and concepts of an embodiment of the disclosure and generally designated by the reference numeral 10 will be described.

As best illustrated in FIGS. 1 through 5, the female form fitting buttstock 10 generally comprises a stock 12 has a top 14, a fore end 16 and a butt end 18. The fore end 16 is configured to couple to a receiver of a shotgun that has a rib sight, which defines a sightline.

The butt end 18 comprises a heel 20 and a toe 22, which are positioned such that the butt end 18 is positively pitched. Pitch is defined as the angle of the butt end 18 of the stock 12 relative to an imaginary line that is perpendicular to the sightline, as shown in FIG. 1. Positive pitch is determined when the toe 22 of the butt end 18 does not reach the imaginary line drawn from the sightline through the heel 20 of the butt end 18. The extent of pitch can be expressed as a distance between the imaginary line and the toe 22 of the butt end 18. In one embodiment, the butt end 18 is positively pitched at from 0.7 to 1.2 centimeters. In another embodiment, the butt end 18 is positively pitched at from 0.9 to 1.0 centimeters.

The stock 12 comprises a grip 24 that is positioned proximate to the fore end 16. The grip 24 is positioned on the stock 12 and is configured to be grasped in a hand of a user with an index finger of the hand positionable proximate to a trigger of the receiver. In one embodiment, the grip 24 comprises a support 26 that extends from a bottom 28 of the stock 12. The support 26 is positioned on the stock 12 such that the support 26 is configured to wrap a middle, ring and pinky fingers of the hand of the user around the support 26.

A channel 30 is positioned in the stock 12. The channel 30 is complementary to a recoil reducer. The channel 30 is positioned in the stock 12 such that the stock 12 is configured to insert the recoil reducer. The channel 30 extends from the butt end 18 to proximate to the grip 24 of the stock 12.

A penetration 32 extends from the channel 30 to the fore end 16. The penetration 32 is positioned in the stock 12 such that the stock 12 is configured to insert a bolt through the channel 30 and the penetration 32 to couple the stock 12 to the receiver.

A pad 34 is reversibly couplable to the butt end 18. In one embodiment, the pad 34 and the fore end 16 are positioned such that a length of pull measurement of thirty to forty centimeters is obtained upon coupling of the stock 12 to the receiver. Length of pull is defined as the distance between a trigger of the receiver and the pad 34, as shown in FIG. 1. In another embodiment, the pad 34 and the fore end 16 are positioned such that a length of pull measurement of thirty four to thirty five centimeters is obtained upon coupling of the stock 12 to the receiver.

The pad 34 has a lower end 36 positioned adjacent to the toe 22. The pad 34 has an upper end 38 that is positioned, in one embodiment, six to twelve centimeters below the sightline. In another embodiment, the upper end 38 is positioned eight to nine centimeters below the sightline.

The buttstock 10 also comprises a plurality of shims 40. The shims 40 are substantially complementary to the pad 34. The shims 40 are reversibly couplable to the butt end 18 of the stock 12 and the pad 34. The shims 40 are positionable between the butt end 18 and the pad 34 such that an increased length of pull measurement is obtained. In one embodiment, the plurality of shims 40 comprises a first shim 42 that increases the length of pull by 0.635 centimeters and a second shim 44 that increases the length of pull by 1.27 centimeters.

The top 14 of the stock 12 comprises a comb 46 that has a top edge 48. The top edge 48 is linear and parallel to the sight line. In one embodiment, the comb 46 is positioned such that a drop at comb measurement of from 3.3 to 4.0 centimeters is obtained upon coupling of the stock 12 to the receiver. Drop at comb is defined as the distance between the sight line and the top edge 48 of the comb 46. In another embodiment, the comb 46 is positioned such that a drop at comb measurement of from 3.6 to 3.7 centimeters is obtained upon coupling of the stock 12 to the receiver. The comb 46 extends toward the bottom 28 of the stock 12 and is positioned proximate to the butt end 18 of the stock 12. In another embodiment, the comb 46 is reversibly couplable to the stock 12, such that the comb 46 is replaceable.

The heel 20 is positioned such that a drop at heel measurement equivalent to the drop at comb measurement is obtained upon coupling of the stock 12 to the receiver. Drop at heel is defined as the distance between the sight line and an upper limit of the heel 20, as shown in FIG. 1.

The toe 22 is positioned outside of a plane defined by the top edge 48 of the comb 46 and the sightline, such that the toe 22 angles away from a torso of the user. In one embodiment, the toe 22 is positioned from 0.7 to 1.2 centimeters outside of the plane defined by the top edge 48 of the comb 46 and the sightline. In another embodiment, the toe 22 is positioned from 0.9 to 1.0 centimeters outside of the plane defined by the top edge 48 of comb 46 and the sightline. The stock 12 is configured such that the toe 22 is positioned on one side of the plane for right handed users and on the other side for left handed users. The top 14 and the bottom 28 of the stock 12 are arcuate, such that the stock 12 is irregularly oblong ovally shaped when viewed from the butt end 18.

In use, the stock 12 is configured to comfortably position within a shoulder pocket of a female user by the positioning of the comb and the heel 20 relative to the sightline, the positioning of the pad 34 relative to a trigger of the receiver, and the positioning of the toe 22 outside of the plane defined by the top edge 48 of the comb 46 and the sightline.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A female form fitting buttstock comprising:

a stock having a top, a fore end and a butt end, said fore end being configured for coupling to a receiver of a shotgun having a rib sight defining a sightline, said butt end comprising a heel and a toe positioned such that said butt end is positively pitched;

a pad reversibly couplable to said butt end, said pad and said fore end being positioned such that a length of pull measurement of thirty to forty centimeters is obtained upon coupling of said stock to the receiver;

said top of said stock comprising a comb, said comb having a top edge, said top edge being linear, said top edge being parallel to the sight line;

said toe being positioned outside of a plane defined by said top edge of said comb and the sightline, such that said toe angles away from the torso of a user; and wherein the positioning of said comb relative to the sightline, the positioning of said pad relative to a trigger of the receiver, and said toe being outside of a plane defined by said top edge of said comb and the sightline, allows the said stock to be configured for positioning within a shoulder pocket of a user.

2. The buttstock of claim 1, further including said butt end being positively pitched at from 0.7 to 1.2 centimeters.

3. The buttstock of claim 2, further including said butt end being positively pitched at from 0.9 to 1.0 centimeters.

4. The buttstock of claim 1, further including a channel positioned in said stock, said channel being complementary to a recoil reducer, wherein said channel is positioned in said stock such that said stock is configured for insertion of the recoil reducer; said channel extending from said butt end to proximate to a grip of said stock.

5. The buttstock of claim 4, further including a penetration extending from said channel to said fore end, wherein said penetration is positioned in said stock such that said stock is configured for insertion of a bolt through said channel and said penetration to couple said stock to the receiver.

6. The buttstock of claim 1, further including said pad and said fore end being positioned such that a length of pull measurement of thirty four to thirty five centimeters is obtained upon coupling of said stock to the receiver.

7. The buttstock of claim 1, further including said pad having a lower end positioned adjacent to said toe, said pad having an upper end positioned six to twelve centimeters below the sightline.

8. The buttstock of claim 7, further including said pad having an upper end positioned eight to nine centimeters below the sightline.

9. The buttstock of claim 1, further including a plurality of shims, said shims being substantially complementary to said pad, said shims being reversibly couplable to said butt end of said stock and said pad, wherein said shims are positionable between said butt end and said pad such that an increased length of pull measurement is obtained.

10. The buttstock of claim 9, further including said plurality of shims comprising a first shim increasing the length of pull by 0.635 centimeters and a second shim increasing the length of pull by 1.27 centimeters.

11. The buttstock of claim 1, further including said comb extending toward a bottom of said stock, said comb being positioned proximate to said butt end of said stock, said comb being positioned such that a drop at comb measurement of from 3.3 to 4.0 centimeters is obtained upon coupling of said stock to the receiver.

12. The buttstock of claim 11, further including said comb being positioned such that a drop at comb measurement of from 3.6 to 3.7 centimeters is obtained upon coupling of said stock to the receiver.

13. The buttstock of claim 1, further including said comb being reversibly couplable to said stock, wherein said comb is replaceable.

14. The buttstock of claim 1, further including said heel being positioned such that a drop at heel measurement equivalent to the drop at comb measurement is obtained upon coupling of said stock to the receiver.

15. The buttstock of claim 1, further including said top and said bottom of said stock being arcuate, wherein said stock is irregularly oblong ovally shaped when viewed from said butt end.

16. The buttstock of claim 1, further including said stock comprising a grip positioned proximate to said fore end, wherein said grip is positioned on said stock such that said grip is configured for grasping in a hand of the user with an index finger of the hand positionable proximate to a trigger of the receiver.

17. The buttstock of claim 16, further including said grip comprising a support extending from said bottom of said stock, wherein said support is positioned on said stock such that said support is configured for wrapping of a middle, ring and pinky fingers of the hand of the user.

18. The buttstock of claim 1, further including said toe being positioned from 0.7 to 1.2 centimeters outside of the plane defined by said top edge of said comb and the sightline.

19. The buttstock of claim 18, further including said toe being positioned from 0.9 to 1.0 centimeters outside of the plane defined by said top edge of said comb and the sightline.

20. A female form fitting buttstock comprising:

a stock having a top, a fore end and a butt end, said fore end being configured for coupling to a receiver of a shotgun having a rib sight defining a sightline, said butt end comprising a heel and a toe positioned such that said butt end is positively pitched, said butt end being positively pitched at from 0.7 to 1.2 centimeters, said butt end being positively pitched at from 0.9 to 1.0 centimeters;

a channel positioned in said stock, said channel being complementary to a recoil reducer, wherein said channel is positioned in said stock such that said stock is configured for insertion of the recoil reducer; said channel extending from said butt end to proximate to a grip of said stock, a penetration extending from said channel to said fore end, wherein said penetration is positioned in said stock such that said stock is configured for insertion of a bolt through said channel and said penetration to couple said stock to the receiver;

a pad reversibly couplable to said butt end, said pad and said fore end being positioned such that a length of pull measurement of thirty to forty centimeters is obtained upon coupling of said stock to the receiver, said pad and said fore end being positioned such that a length of pull measurement of thirty four to thirty five centimeters is obtained upon coupling of said stock to the receiver, said pad having a lower end positioned adjacent to said toe, said pad having an upper end positioned six to twelve centimeters below the sightline, said pad having an upper end positioned eight to nine centimeters below the sightline;

a plurality of shims, said shims being substantially complementary to said pad, said shims being reversibly couplable to said butt end of said stock and said pad, wherein said shims are positionable between said butt end and said pad such that an increased length of pull measurement is obtained, said plurality of shims comprising a first shim increasing the length of pull by 0.635 centimeters and a second shim increasing the length of pull by 1.27 centimeters;

said top of said stock comprising a comb, said comb having a top edge, said top edge being linear, said top edge being parallel to the sight line, said comb being positioned such that a drop at comb measurement of from 3.3 to 4.0 centimeters is obtained upon coupling of said stock to the receiver, said comb being positioned such that a drop at comb measurement of from 3.6 to 3.7 centimeters is obtained upon coupling of said stock to the receiver, said comb extending toward a bottom of said stock, said comb being positioned proximate to said butt end of said stock, said comb being reversibly couplable to said stock, wherein said comb is replaceable;

said heel being positioned such that a drop at heel measurement equivalent to the drop at comb measurement is obtained upon coupling of said stock to the receiver;

said toe being positioned outside of a plane defined by said top edge of said comb and the sightline, such that said toe angles away from the torso of a user, said toe being positioned from 0.7 to 1.2 centimeters outside of the plane defined by said top edge of said comb and the sightline, said toe being positioned from 0.9 to 1.0 centimeters outside of the plane defined by said top edge of said comb and the sightline;

said top and said bottom of said stock being arcuate, wherein said stock is irregularly oblong ovally shaped when viewed from said butt end;

said stock comprising a grip positioned proximate to said fore end, wherein said grip is positioned on said stock such that said grip is configured for grasping in a hand of the user with an index finger of the hand positionable proximate to a trigger of the receiver, said grip comprising a support extending from said bottom of said stock, wherein said support is positioned on said stock such that said support is configured for wrapping of a middle, ring and pinky fingers of the hand of the user; and wherein the positioning of said comb and said heel relative to the sightline, the positioning of said pad relative to a trigger of the receiver, and said toe being outside of a plane defined by said top edge of said comb and the sightline, allows the said stock to be configured for positioning within a shoulder pocket of a user.

* * * * *